United States Patent [19]

Turner

[11] 4,381,737

[45] May 3, 1983

[54] ROTARY VALVED INTERNAL COMBUSTION ENGINE

[76] Inventor: William H. Turner, 12 S. Monitor Pl., Tucson, Ariz. 85710

[21] Appl. No.: 206,570

[22] Filed: Nov. 13, 1980

[51] Int. Cl.[3] ..... F01P 3/14

[52] U.S. Cl. ..... 123/41.4; 123/190 A; 165/104.26

[58] Field of Search ..... 123/41.40, 190 A; 165/104.22, 104.26

[56] References Cited

U.S. PATENT DOCUMENTS

| | | | |
|---|---|---|---|
| 1,068,632 | 7/1913 | Dam et al. | 123/41.4 |
| 3,731,660 | 5/1973 | Leffert | 165/104.26 |
| 3,828,849 | 8/1974 | Corman et al. | 165/104.26 |
| 3,838,668 | 10/1974 | Hays et al. | 165/104.26 |
| 3,884,293 | 5/1975 | Pessolano et al. | 165/104.26 |

*Primary Examiner*—Craig R. Feinberg
*Assistant Examiner*—W. R. Wolfe
*Attorney, Agent, or Firm*—Drummond, Nelson & Nissle

[57] ABSTRACT

An improved device for fluidly sealing rotary valves to the housing of a rotary valved internal combustion engine. The device comprises self-lubricating sleeve-like members which are compressed between the rotary valves and engine housing. The sleeve-like members lubricate the cylindrical surfaces of the rotary valves, fluidly seal the valves to the housing, and provide bearing surfaces which maintain the rotary valves in their proper position in the housing.

4 Claims, 13 Drawing Figures

ROTARY VALVED INTERNAL COMBUSTION ENGINE

This invention relates to an improved rotary valved internal combustion engine.

More particularly, the invention concerns an improved rotary valved internal combustion engine of the type having a housing with at least one piston member reciprocally mounted within a cylinder formed in the housing and having cylindrical rotary valve members provided with diametric throughbores which, at predetermined rotational positions of the rotary valve members, intermittently align with intake and exhaust passages extending to the cylinder combustion chamber.

Even more specifically, the invention conerns a rotary valved internal combustion engine of the general type disclosed in issued U.S. Pat. Nos. 3,896,781 to Smith and 4,198,946 to Rassey, having improved self-lubricating fittings for fluidly sealing the rotary valve to the housing and an improved mechanism for cooling the rotary valves during operation of the internal combustion engine.

In yet another further and more specific respect the invention relates to an improved rotary valved internal combustion engine which does not require a continual flow of oil or other liquid to lubricate and cool the bearing surfaces circumscribing and supporting rotary valve members in the housing of the engine.

In still another aspect, the invention relates to an improved rotary valved internal combustion engine in which the cylindrical bores receiving the rotary valve members do not have to be precisely machine finished or formed to dimensions within specified narrow tolerances and can instead be utilized as formed during casting of the housing.

In still a further respect, the invention relates to a rotary valved internal combustion engine having improved fittings for fluidly sealing the rotary valve members to the housing which reduce the complexity and cost of production of the engine.

The general type of rotary valved internal combustion engine described in the U.S. Pat. Nos. 3,896,781 to Smith and 4,198,946 to Rassey are well known in the art. Utilizing the rotary valve systems described in these patents in place of conventional poppet valve systems is desirable for a number of reasons. Rotary valve systems are, in comparison to poppet valve systems and their attendant reciprocal driving mechanisms, relatively inexpensive to produce and install and are compact and lightweight in construction. Rotary valves have the added advantage of not obstructing the combustion chamber inlet and outlet passages as do the circular head and stem of a conventional poppet valve.

However, despite these advantages, rotary valves have not as yet achieved widespread commercial acceptance and use. One characteristic of a rotary valve responsible for this limited acceptance is the tendency of the valve to warp when subjected to the high temperatures normally encountered during engine operation. Such warpage often necessitates the replacement of the rotary valve member. The Rassey patent describes a system which circulates coolant through the interior of each rotary valve in an attempt to minimize this problem. The various fluid seals required in installing this coolant system further complicate construction of the rotary valved engine.

Yet another drawback of previously know rotary valves is that the cylindrical bore receiving the valves must be machined in the housing to within relatively small tolerances and the valve members carried in the housing by bearings manufactured to within similarly precise tolerances. The machining necessary to form the throughbores and to produce the bearings increases the cost of constructing a rotary valved engine.

The sealing elements normally used to seal the rotary valve to the engine housing compound the complexity and production cost of the rotary valved engine. Typically, as is the case in the Smith and Rassey patents, additional pockets must be formed in the housing to retain elements which bear against and seal the rotary valve members. Oil and/or engine combustion by-products tend to accumulate in such pockets and reduce or destroy the operational effectiveness of the sealing elements.

Accordingly, it would be highly desirable to provide an improved rotary valved internal combustion engine of the type described above having simple and efficient cooling and sealing mechanisms which lead to increased long term mechanical reliability and overall reduction in the complexity and cost of production of the engine.

Therefore, it is a principal object of the present invention to provide an improved rotary valved internal combustion engine.

Another principal object of the invention is to provide an improved rotary valved internal combustion engine of the type having a housing with at least one piston member reciprocally mounted within a cylinder formed in the housing and having cylindrical rotary valve members provided with throughpassages which, at predetermined rotational positions of the rotary valve members, intermittently align and establish fluid communication with the intake and exhaust passages extending to the cylinder combustion chamber.

Another and more specific object of the instant invention is to provide improvements in the general type of rotary valved engine described in U.S. Pat. Nos. 3,896,781 to Smith and 4,189,946 to Rassey.

Still another object of the invention is to provide an improved rotary valved internal combustion engine having self-lubricating sealing and bearing surfaces.

Yet another object of the invention is to provide an improved rotary valved engine in which the cylindrical bores receiving the rotary valve members can be formed during casting of the housing and be utilized without having to be machine finished to within narrow tolerances.

Still another and further object of the invention is to provide an improved rotary valved engine having sealing and bearing mechanisms which lead to increased long term mechanical reliability and reduce the complexity and production costs of the engine.

These and other further and more specific objects and advantages of the invention will be apparent to those skilled in the art from the following detailed description thereof, taken in conjunction with the drawings, in which.

Figure 1:
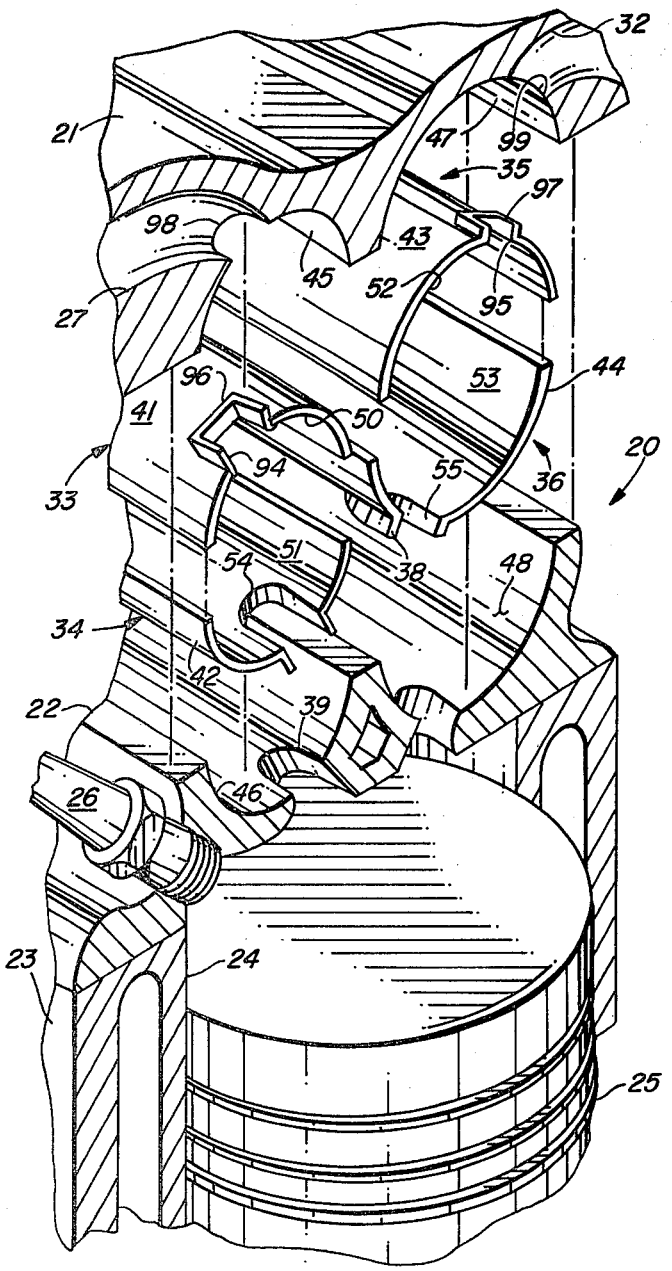
FIG. 1 is a partial perspective assembly view of an improved rotary valved internal combustion engine which includes valve seals and bearings constructed in accordance with one embodiment of the invention.

Briefly, in accordance with one embodiment of my invention, I provide an improved sealing and bearing mechanism for a rotary valved internal combustion engine. The rotary valved engine includes a housing; at least one combustion chamber formed in the housing; at least one piston member reciprocally received in the combustion chamber; passage means formed in the housing for communicating a combustible mixture to the combustion chamber and for transporting exhaust gasses from the combustion chamber; ignition means for igniting the combustible mixture in the combustion chamber; at least one cylindrical valve member rotatably journalled in the housing and having at least one through-passage formed therein, the valve member being disposed in the passage means such that the through-passage selectively establishes fluid communication through the passage means at predetermined rotational positions of the rotary valve member; and means for rotatably driving the valve member is synchronism with the operation of the engine. The improved sealing and bearing means comprises self-lubricating sleeve means in a state of compression positioned between the cylindrical surface of the valve member and the housing and having at least two surfaces, an outer surface contacting the housing, and an inner annular bearing surface sealingly engaging at least a portion of the cylindrical surface of the rotary valve member. The inner surface of the sleeve means is comprised at least in part of a substance which minimizes the friction between the bearing surface and the cylindrical surface of the valve member during the rotation thereof. The sleeve means is shaped and dimensioned to define at least one radial opening positioned such that fluid intermittently flows along the passage means and through the radial opening and through the through-passage at predetermined rotational positions of the rotary valve member.

In another embodiment of my invention I provide improved means for cooling the valve members during the operation of a rotary valved internal combustion engine. The engine includes a housing; at least one combustion chamber formed in the housing; at least one piston member reciprocally received in the combustion chamber; passage means formed in the housing for communicating a combustible mixture to the combustion chamber and for transporting exhaust gasses from the combustion chamber; ignition means for igniting the combustible mixture in the combustion chamber; at least one cylindrical valve member rotatably journalled in the housing and having at least one through-passage formed therein, the valve member being disposed in the passage means such that the through-passage selectively establishes fluid communication through the passage means at predetermined rotational positions of the rotary valve member; and means for rotatably driving the valve member in synchronism with the operation of the engine. The improved cooling means comprises heat pipe means having at least two operative sections, an elongate evaporator section mounted within the engine housing for absorbing heat from the valve member, the absorbed heat vaporizing liquid condensate contained in the evaporator section, and a condensor section for receiving and condensing the vaporized liquid flowing from the evaporative section, the condensate produced in said condensor section flowing to said evaporator section; and, heat sink means for absorbing heat from the condensor section of the heat pipe means.

In yet another embodiment of the invention I provide improved means for continuously sealing the valve members to the housing in a rotary valved internal combustion engine. The engine includes a housing having an upper portion and a lower portion; at least one combustion chamber formed in the housing; at least one piston member reciprocally received in the combustion chamber; passage means formed in the housing for communicating a combustible mixture to the combustion chamber and for transporting exhaust gasses from the combustion chamber; ignition means for igniting the combustible mixture in the combustion chamber; at least one cylindrical valve member rotatably journalled in the housing and having at least one throughpassage formed therein, the valve member being disposed in the passage means such that the through-passage selectively establishes fluid communication through the passage means at predetermined rotational positions of the rotary valve member and being positioned in part within each of said upper and lower portions of said housing; and means for rotatably driving said valve member in synchronism with the operation of the engine. The improved sealing means comprises sleeve means in a state of compression positioned between the cylindrical surface of the valve member and the housing and having at least two surfaces, an outer surface contacting the housing, and an inner annular bearing surface sealingly engaging at least a portion of the cylindrical surface of the rotary valve member, the inner surface being comprised at least in part of a substance which minimizes the friction between the inner surface and the cylindrical surface of the valve member during the rotation thereof; and, means for detachably fixedly securing the upper portion of the housing to the lower portion thereof and for compensating for the wear of the inner bearing surface of the sleeve means. The sleeve means is shaped and dimensioned to define at least one radial opening positioned such that fluid intermittently flows along the passage means and through the radial opening and through the throughpassage at predetermined rotational positions of the rotary valve member. The wear compensating means includes compliant gasket means positioned between the upper portion and lower portion of the housing; fastening means for detachably fixedly securing the upper portion to the lower portion of the housing; and resilient spring means compressed against said housing by the fastening means such that the compliant gasket is compressed and the upper portion is urged toward the lower portion of the housing in response to the wear of the inner bearing surface of said sleeve means.

Figure 2:
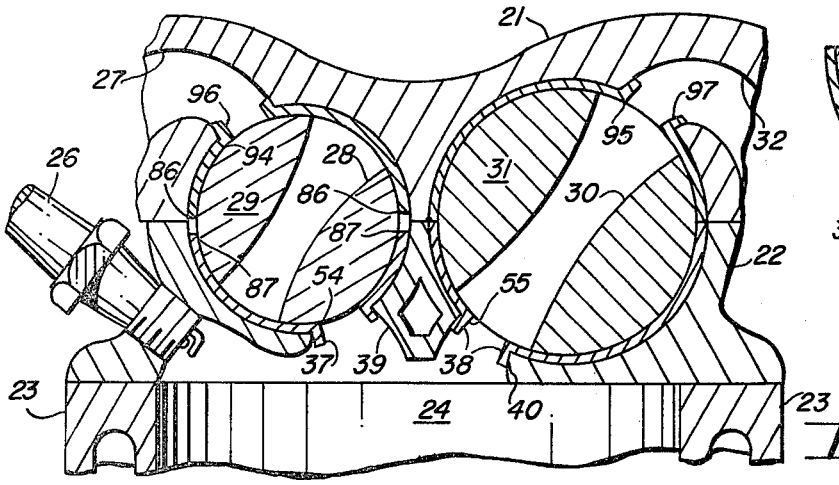
FIG. 2 is a sectional elevational view of an improved rotary valved engine showing the rotary valve members provided with the improved valve bearings of FIG. 1.

Turning now to the drawings, which depict the presently preferred embodiments of the invention for the purpose of illustrating the practice thereof and not by way of limitation of the scope of the invention, and in which like reference characters identify corresponding elements throughout the several views, FIGS. 1 and 2 illustrate a portion of an internal combustion engine constructed in accordance with one embodiment of the invention. The internal combustion engine is generally designated by reference character 20 and includes housing members 21, 22 and 23. Cylinder 24 of engine 20 is formed within housing block member 23 and reciprocally receives piston 25. Spark plug 26 periodically ignites a measured volume of combustible mixture which periodically enters cylinder combustion chamber 24 through inlet passage 32 and diametrically formed passageway 30 of rotary valve member 31. Exhaust gasses formed in cylinder 24 during combustion are intermittently ejected through diametrically formed passageway 28 of rotary valve member 29 and exhaust passage 27 formed in housing head assembly member 22. Rotary valve members 31 and 29 have, for the sake of clarity, been omitted from FIG. 1.

Semi-circular sleeve seals 33, 34 and 35, 36 are respectively compressed between rotary valve members 29, 31 and housing head assembly members 21 and 22. Projecting depending lips 37, 38, 96, 97 around apertures 54, 55, 94, 95 of seals 34, 36 are received respectively by oval apertures 39, 40, 98, 99 formed in housing head assembly member 22 and prevent the rotation of seals 33–36 in housing 20.

The outer surfaces 41–44 of seals 33–36 are preferably comprised of somewhat compliant material which will, then compressed between valves 29, 31 and housing 20, accommodate minor variation in the concave cylindrical surfaces 45, 46, 47 and 48. The inner bearing surfaces 50, 51, 52 and 53 of seals 33, 34, 35 and 36 are comprised at least in part of a self-lubricating substance which minimizes the frictional forces between inner surfaces 50–53 of seals 33–36 and valves 29, 31. Drive means (not shown) rotate valve members 29, 31 in synchronism with the reciprocation of piston 25 in cylinder 24.

Figure 3:
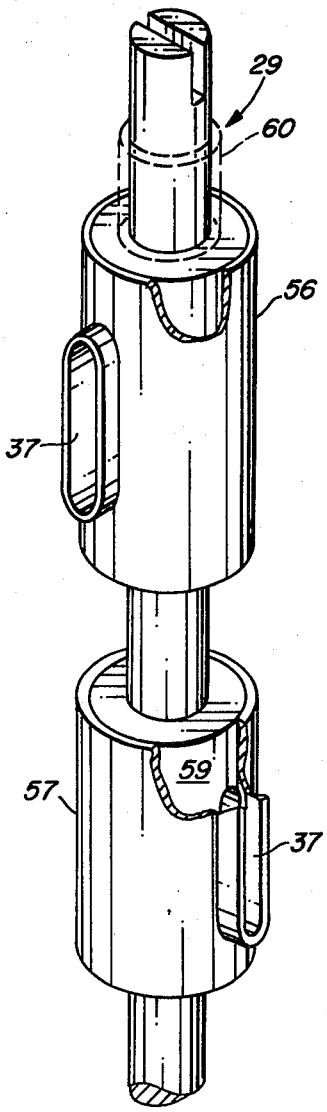
FIG. 3 is a perspective view of a single rotary valve member provided with valve seals constructed in accordance with the invention.
Figure 8:
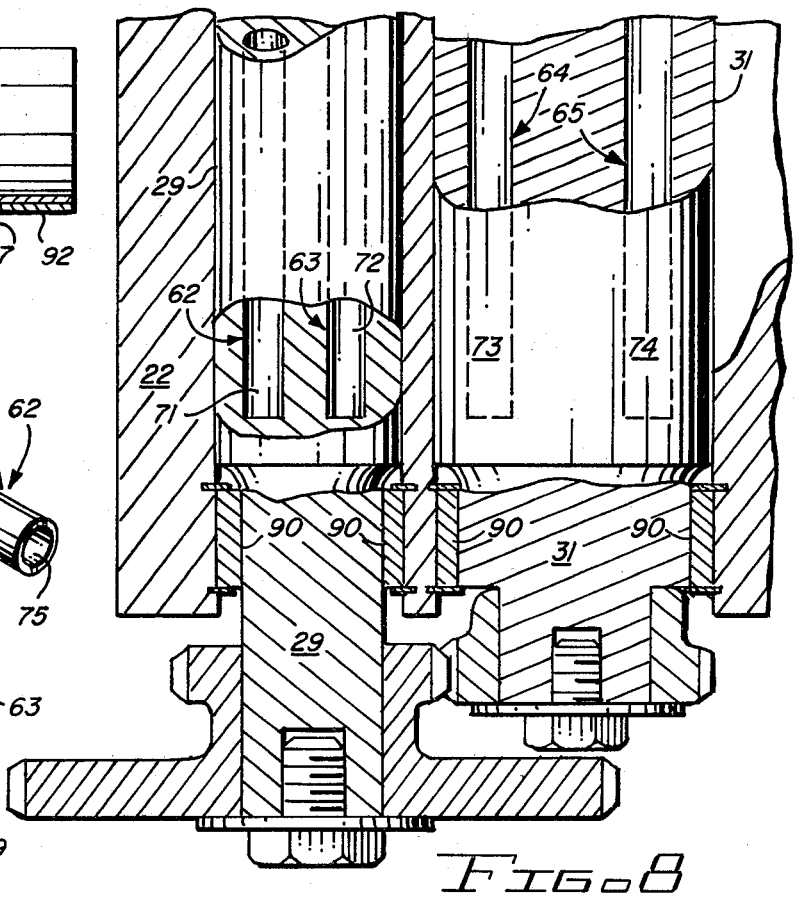
FIG. 8 is a top sectional view of an improved rotary valve mechanism provided with heat pipes for transferring heat therefrom and having outer portions thereof broken away to further illustrate the internal construction thereof.
Figure 7:
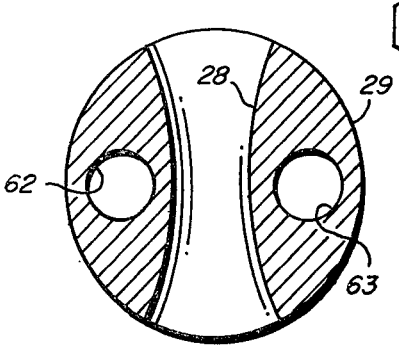
FIG. 7 is a sectional view of the rotary valve of FIG. 6 taken along section line 7—7 thereof.
Figure 9:
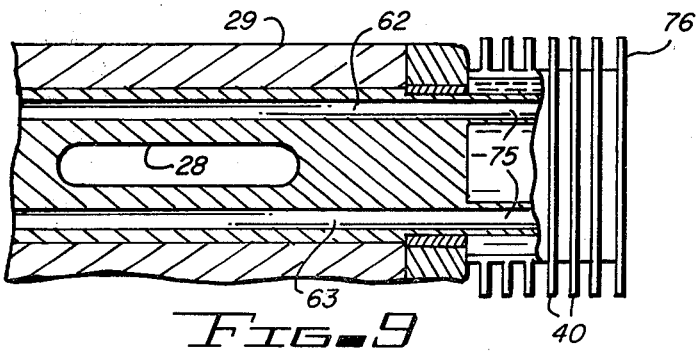
FIG. 9 is a sectional elevational view of the rotary valve of FIG. 6 in combination with a heat sink for absorbing energy from the heat pipes positioned in the rotary valve.
Figure 10:
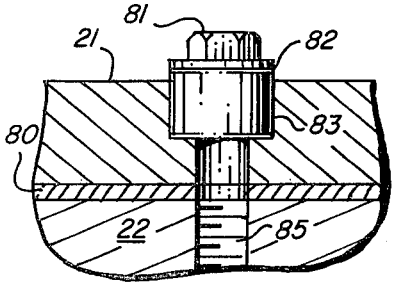
FIG. 10 is a side sectional view of the rotary valve housing illustrating fastening means constructed in accordance with yet another embodiment of the invention for connecting the upper and lower portions of the housing.
Figure 12A:
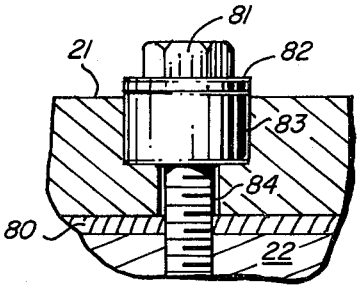
FIGS. 12A and 12B are side views of the fastening means of FIG. 10 illustrating the mode of operation thereof.
Figure 12B:
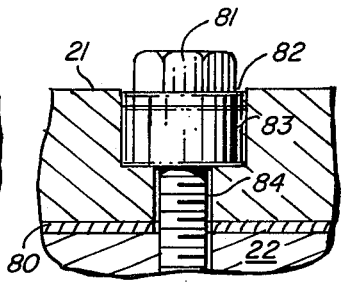
Figure 11:
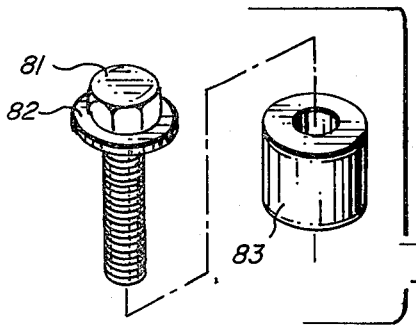
FIG. 11 is a perspective assembly view of the fastening means of FIG. 10.

As shown in FIG. 3, the sleeve means may include cylindrical segments 56, 57 which are intact around the entire circumference thereof and are slid into position on the large diameter portions 58, 59 of valve member 29 or valve member 31. Utilization of the semi-circular segments 33–36 shown in FIG. 1 is presently preferred because of the ease of installation of such segments. Self-lubricating bearings could also, as shown by dashed lines 60 in FIG. 3 and by bearings 90 in FIG. 8 be emplaced on the reduced diameter portions of shaft members 29, 31.

Figure 4:
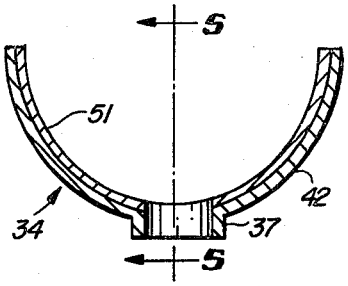
FIG. 4 is a partial sectional view of a rotary valve member in sealing engagement with an improved valve seal of FIG. 1.
Figure 5:
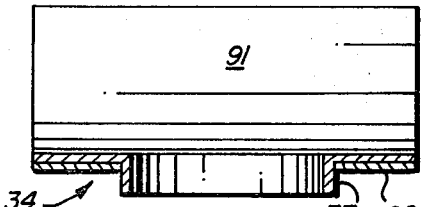
FIG. 5 is a partial sectional view of the rotary valve member of FIG. 4 taken along section line 5—5 thereof.
Figure 6:
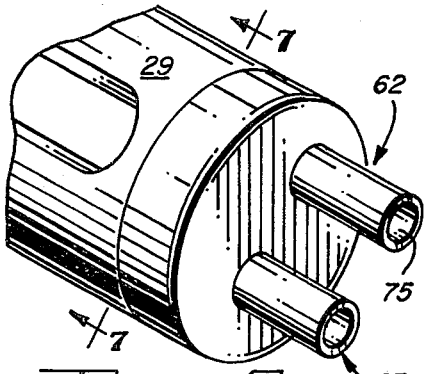
FIG. 6 is a partial perspective view of a rotary valve member provided with heat pipes in accordance with another embodiment of the invention.

Although seals 33–36 could be fabricated from a single suitable material, composite bi-layer seals are presently preferred in the practice of the invention. Such composite seals include a high temperature inner layer provided at least in part with a lubricating material like graphite and a somewhat malleable, high temperature, outer layer which adapts to variations in the generally smooth, even contour of cylindrical surfaces 45–48. A seal 34 utilizing the optional bi-layer construction is shown in FIGS. 4 and 5 and comprises inner lubricating layer 51 and outer layer 42.

The ability of outer seal surfaces 41–44 to adapt to and accommodate variation in the continuity of cylindrical surfaces 45–48 eliminates the necessity of machining cylindrical surfaces 45–48 to within narrow tolerances. Instead, surfaces 45–48 can be utilized as formed during casting of the housing, ie., the seals 33–36 can be compressed against cast surfaces 45–48. In addition, self-lubricating inner bearing surfaces 50–53 permit the rotary valve engine to be operated without having to provide a continuous flow of oil or other liquid to lubricate valve bearing or sealing surfaces.

Ideally, the self-lubricating sleeve means is radially elastic so that as the inner bearing surfaces 50–53 wear the elastic expansion of the sleeve means maintains the fluid seal between the rotary valve member and inner lubricating surface of the sleeve means and thus, prolongs the operational life of the seal. Elastic sealing members 56, 57 on the larger diameter portions 58, 59 of rotary valve shaft 29 as shown in FIG. 3 tend to absorb and compensate for temporary localized distortions which occur along shafts 29, 31 during operation of the engine.

Sleeve means 33–36 constructed in accordance with the invention fulfill three distinct functions: the lubrication of the rotary valves, the sealing of the valve to the housing, and the provision of a bearing surface to maintain the cylindrical surface of the rotary valve concentric with the axis of rotation thereof.

Venturi shaped through-passages 28 and 30 of shafts 29 and 31 provide, in comparison to conventional cylindrical shaped valve through-passages, an increase in the time the inlet 32 and the outlet 27 passages are open and also provide improved fluid flow into and from cylinder 24.

FIGS. 6–9 illustrate an improved rotary valve mechanism which is constructed in accordance with another embodiment of the invention and includes heat pipes 62, 63, 64 and 65. Heat pipes 62–65 typically comprise sealed tubes containing a fixed amount of working liquid. Each heat pipe normally has at least two operative sections, an evaporator section located at one end of the sealed tube and a condensing section located at the opposite end of the tube. In operation, heat absorbed by the evaporator end of the heat pipe vaporizes working liquid contained therein. The vaporized liquid flows to the opposite end of the heat pipe where it is condensed and returned to the evaporator end to repeat the cycle. The condensate can, depending on the type of heat pipe employed, be returned to the evaporator end of the heat pipe by gravity, capillary force, centripetal force, electrostatic volume forces, magnetic volume forces or osmotic forces. Heat pipes are characterized by very high effective thermal conductance and by the ability to act as a thermal flux transformer. In addition, the surface of the condenser end of the heat pipe operates as an isothermal surface of low thermal impedance. It is possible to construct heat pipes for use at temperatures ranging from 4 degrees K. to 2300 degrees K.

As shown in FIGS. 6–9, the evaporator sections 71–74 of heat pipes 62, 63, 64 and 65 may be mounted within rotary valve members 29, 31 while the condensor sections 75 of the heat pipes are contacted with a heat sink 76 which removes energy from the heat pipes to transform vaporized liquid into condensate which is returned to the evaporator sections of the heat pipes. The heat pipes could, of course, also be positioned in the engine housing adjacent to the bores retaining the rotary valve members. As would be appreciated by those of skill in the art, the heat sink function could be performed by a section of a valve member or engine.

Utilization of heat pipes to cool rotary valve members 29, 31 eliminates the fluid seals required when coolant is circulated through the interior of the rotary valve and, more importantly, provides a means for rapidly conducting heat from the rotary valve so that the operating temperature thereof is maintained at a low level. Maintaining a minimal operating temperature lengthens the operational life of valve components and reduces warpage of valve shafts during operation of the engine.

Still another embodiment of the invention is shown in FIGS. 10–12B and includes compliant gasket 80 sandwiched between the upper housing member 21 and lower housing member 22. Threaded bolt 81 is passed through washer 82, resilient spring means 83, aperture 84 and rotated into internally threaded aperture 85 of housing member 22. When bolt 81 is torqued to the required specification, resilient spring means 83 is completely compressed. As the inner surface of surfaces 50–53 of seals 33–36 gradually wear, elastomeric spring 83 compresses compliant gasket 80 and urges upper housing member 21 toward lower housing member 22 and automatically tightens seals 33–36 against rotary valve members 29 and 31. Although bolt 81 may eventually have to be tightened or seals 33–36 replaced, a plurality of such bolt 81—spring 83 combinations effectively provide at least a temporary automatic compensation and tightening of seals 33–36 against valves 29, 31 in response to the wearing of inner bearing surfaces 50–53. To improve the effectiveness of this "self-compensating" system, seals 33, 34 and 35, 36 may, as shown in FIG. 2 be formed so that edges 86, 87 are slightly apart when the seals are initially installed. This allows the seals 33, 34 to be slightly compressed toward one another by springs 83 without having the tendency to buckle at points adjacent edges 86, 87.

As would be appreciated by those of skill in the art, the above-described embodiments of the invention could be readily adapted to a variety of rotary valved internal combustion engines including, for example, the engines described in U.S. Pat. Nos. 4,007,725 to Weaver, 4,019,487 to Guenther, and 4,010,727 to Cross et al.

Having described my invention in such terms as to enable those skilled in the art to understand and practice it, and having identified the presently preferred embodiments thereof, I claim:

1. In combination with an internal combustion engine, including a housing, at least one combustion chamber formed in said housing, passage means formed in said housing for communicating a combustible mixture to said combustion chamber and for transporting exhaust gases from said combustion chamber, ignition means for igniting said combustible mixture in said combustion chamber, at least one cylindrical valve member rotatably journalled in said housing and having at least one opening formed therein, and an imaginary centerline generally equidistant from points on the cylindrical surface of said valve member, said rotary valve member being disposed in said passage means such that said opening selectively establishes fluid communication through at least a portion of said passage means at predetermined rotational positions of said rotary valve member, and means for rotatably driving said valve member in synchronism with the operation of said engine, means for cooling said rotary valve member during the operation of said internal combustion engine, said cooling means including (a) an elongate heat pipe having at least two operative sections, (i) an evaporator section carried within said rotary valve member to absorb heat from the valve during operation of said engine, said absorbed heat vaporizing liquid condensate contained in said evaporator section, and (ii) a condensor section positioned outside said rotary valve member for receiving and condensing said vaporized liquid flowing from said evaporator section, said condensate produced in said condensor section flowing to said evaporator section, the positioning of said heat pipe in said rotary valve member increasing the efficiency of the heat pipe in cooling said rotary valve member, and minimizing distortion of said valve member which occurs during operation of said engine.

2. The internal combustion engine of claim 1 in which said evaporator section of said heat pipe is positioned in said rotary valve member generally parallel to said imaginary centerline thereof.

3. The internal combustion engine of claim 1 including heat sink means for absorbing heat from said condenser section of said heat pipe.

4. The internal combustion engine of claim 3 wherein said heat sink means is fixedly attached to said engine and said condensor section of said heat pipe rotates in said heat sink means during operation of said internal combustion engine.

* * * * *